US007057145B2

(12) United States Patent
Kang

(10) Patent No.: US 7,057,145 B2
(45) Date of Patent: Jun. 6, 2006

(54) MENU SELECTION DEVICE IN MICROWAVE OVEN

(75) Inventor: Dae-Ho Kang, Changwon Kyeongnam (KR)

(73) Assignee: LG Electronics Inc., Seoul (KR)

( * ) Notice: Subject to any disclaimer, the term of this patent is extended or adjusted under 35 U.S.C. 154(b) by 50 days.

(21) Appl. No.: 10/314,376

(22) Filed: Dec. 9, 2002

(65) Prior Publication Data

US 2003/0150853 A1 Aug. 14, 2003

(30) Foreign Application Priority Data

Feb. 14, 2002 (KR) ..... 10-2002-0008040

(51) Int. Cl.
*H05B 6/68* (2006.01)

(52) U.S. Cl. ..... 219/720; 219/702; 219/727; 219/754; 99/DIG. 14

(58) Field of Classification Search ..... 219/702, 219/720, 506, 727, 754; 99/DIG. 14; 426/234, 426/241, 243
See application file for complete search history.

(56) References Cited

U.S. PATENT DOCUMENTS 4,551,601 A * 11/1985 Nishimura ..... 219/710
5,653,906 A * 8/1997 Fowler et al. ..... 219/716
6,097,016 A * 8/2000 Hirata et al. ..... 219/720
6,353,214 B1 * 3/2002 Choi ..... 219/702

FOREIGN PATENT DOCUMENTS

JP 2000-065360 3/2000

* cited by examiner

*Primary Examiner*—Robin Evans
*Assistant Examiner*—Leonid M. Fastovsky
(74) *Attorney, Agent, or Firm*—Fleshner & Kim, LLP

(57) ABSTRACT

A menu selection device for a microwave oven is provided which is constructed such that a single display device may be divided into a menu guide unit and a menu selection unit. The menu guide unit is used to display a variety of menus, whereas the menu selection unit is constructed in the form of a touch screen which allows for selection of a particular menu from among the menus displayed on the menu guide unit. Use of a menu guide unit and a menu selection unit within a single display device makes a greater variety of cooking alternatives available to a user, while decreasing the size of the touch screen portion of the menu selection device and decreasing production costs.

24 Claims, 5 Drawing Sheets

MENU SELECTION DEVICE IN MICROWAVE OVEN

BACKGROUND OF THE INVENTION

1. Field of the Invention

The present invention relates to a menu selection device in a microwave oven, and more particularly, to a menu selection device in a microwave oven constructed such that a single display device can be used in a state where it is divided into a menu guide unit and a menu selection unit.

2. Description of the Prior Art

Generally, a touch screen is a special cathode ray tube screen with an infrared film, and more specifically, a device for sensing a position touched by a user on the cathode ray tube screen and outputting information corresponding to the sensed position. The touch screen is widely used as a device for selecting and inputting various signals in automated teller machines for banks, information kiosks in public places and a variety of electronic appliances.

Recently, as a great deal of various high quality electronic products have been produced, the touch screen has been largely used in the electronic appliances. Even in case of a microwave oven, the touch screen is also used as a device for displaying and selecting menus.

FIG. 1 is a perspective view of a conventional microwave oven with a touch screen installed therein, and FIG. 2 is a view showing a use state where menus are displayed on the touch screen.

That is, in the conventional microwave oven, a control panel 7 is installed at a side of a cooking chamber 5, i.e. a front portion of an electronic equipment installation chamber in which a magnetron and various kinds of electronic parts are installed. Various kinds of buttons, a display device 1 for displaying and inputting menus, and the like are installed at the control panel 7.

As shown in FIG. 2, the display device 1 is composed of the touch screen on which various kinds of menus provided in the microwave oven are displayed so that a user can personally select a desired menu among the displayed menus. Further, the display device 1 installed at the control panel 7 of the conventional microwave oven is constructed such that both display and input of the menus can be performed on the entire area thereof. Therefore, the display device 1 provided in the conventional microwave oven should be constructed such that the entire area thereof is manufactured in the form of the touch screen.

To this end, the microwave oven should also be constructed to have a control configuration shown in FIG. 3.

FIG. 3 shows the configuration in which the display device I for use in the conventional microwave oven is composed of an infrared touch screen for sensing whether the touch screen has been touched. The infrared touch screen comprises a processor 10 for generating a relevant control signal by accessing software through an input means such as a finger or a special pen and for processing a coordinate of a position on a CRT display unit 18 touched by the input means, an infrared rays generating unit 14 for generating infrared rays in response to the control signal generated from the processor 10, an infrared rays receiving unit 16 for determining the presence of the infrared rays generated from the infrared rays generating unit 14, and the CRT display unit 18 for displaying the coordinate of the predetermined position touched by the input means on the basis of the presence of the infrared rays. In addition, reference numerals 12*a* and 12*b* designate write and read buffers. The write buffer 12*a* temporarily stores the control signal received from the processor 10 and then transmits the stored signals to the infrared rays generating unit 14, whereas the read buffer 12*b* also temporarily stores data related to the infrared rays from the infrared generating unit 14 and transmits the stored data to the processor 10.

In addition, the infrared rays generating unit 14 is constructed to transmit the infrared rays along an x-axis (abscissa of the figure) and y-axis (ordinate of the figure) of the CRT display unit 18. Light-emitting devices provided along the x- and y-axes of the infrared rays generating unit 14 are provided to correspond to light-receiving devices of the infrared rays receiving unit 16 to be described later in detail. In FIG. 3, it is shown that the fifteen (15) light emitting/light receiving devices are placed along the x-axis, and eleven (11) light-emitting/light-receiving devices are placed along the y-axis of the CRT display unit.

The infrared rays receiving unit 16 performs a function of determining the presence of the infrared rays transmitted from the infrared rays generating unit 14 so that the processor 10 can sense an touch action exerted on the CRT display unit 18. According to the number of the light-emitting/light-receiving devices, resolution of the touch screen is determined. If the aforementioned light-emitting/light-receiving devices are provided, the resolution becomes "15×11".

A coordinate determination process in the CRT display unit 18 of the conventional infrared rays touch screen constructed as such will be described as follows.

First, if the processor 10 supplies a predetermined control signal to the infrared rays generating unit 14 through the write buffer 12*a*, the infrared rays generating unit 14 generates the infrared rays in response to the control signal from the processor 10 and transmits the generated infrared rays onto the infrared rays receiving unit 16 in the directions of the x- and y-axes. When the touch action is exerted on a specific position of the CRT display unit 18 together with the transmission of the infrared rays, any one piece of the data corresponding to the transmitted infrared rays is not transmitted to (i.e. received at) the infrared rays receiving unit 16. Based on pieces of the data received in the infrared rays receiving unit 16, accordingly, the processor 10 determines that the touch action has been made at the predetermined position of the CRT display unit 18.

In other words, if all the infrared rays transmitted from the infrared rays generating unit 14 arrive at the infrared rays receiving unit 16, it indicates that any input devices have not come into contact with the CRT display unit 18. However, if any infrared rays do not arrive at specific light-receiving devices of the infrared rays receiving unit 16, it indicates that the input device is in contact with the CRT display unit 18, i.e. a specific position of the touch screen.

For example, the processor 10 assigns the data value "1" to the respective fifteen light-emitting devices of the infrared rays generating unit 14 placed along the x-axis of the CRT display unit and then causes the infrared rays having the assigned value to be transmitted to the corresponding light-receiving devices of the infrared rays receiving unit 16 placed along the x-axis thereof. The infrared rays receiving unit 16 receives the transmitted infrared rays having the assigned data value, i.e. value of "1", and the processor 10 reads the value of "1" and determines that any input devices have not come into contact with the CRT display unit.

However, if the specific light-receiving devices of the infrared rays receiving unit 16 do not receive the infrared rays transmitted from the corresponding light-emitting devices of the infrared rays generating unit 14, the processor 10 reads a data value "0" instead of the assigned data value "1". In such a case, the processor 10 determines that the input device is in contact with the CRT display unit 18 on the predetermined position thereof, as described above.

Further, the processor 10 assigns the data value "1" to the eleven light-emitting devices of the infrared rays generating unit 14 placed along the y-axis and then causes the infrared rays having the assigned data value "1" to be transmitted to the corresponding light-receiving devices of the infrared rays receiving unit 16 placed along the y-axis, the processor reads the data value of the infrared rays transmitted to the infrared rays receiving unit 16 and determines a state where the input device has come into contact with the CRT display unit. Through such a process, the x and y coordinates of the predetermined position on the touch screen, which is touched by the input device, can be obtained.

In order to sense whether any positions on the CRT display unit 18 have been touched by the input means as above, the entire area of the CRT display unit 18 must be constructed in the form of the touch screen so that the configuration and sensing method shown in FIG. 3 can be established and performed. Therefore, according to the conventional microwave oven, the entire area of the display device 1 must be processed in the form of the touch screen in order to sense the touch action throughout the entire area of the display device 1.

In addition, if cooking menus are displayed on the display unit 1 constructed in the form of the touch screen as shown in FIG. 2, selection of a desired cooking menu can be made by merely bringing the input device into contact with the position on the display unit where the desired cooking menu is displayed. As an example, if the user intends to select a "POPCORN" menu, he/she selects the "POPCORN" menu by simply bringing the input device into contact with a fourth line (item) on which "POPCORN" is displayed.

As described above, according to the conventional microwave oven, the display and selection of the cooking menus are performed by using the display device 1 of which entire area is constructed in the form of the touch screen.

However, the conventional microwave oven in which the entire area of the display device 1 thereof is constructed and used in the form of the touch screen has the following problem.

In products employing the touch screen, the size of the touch screen should be determined by considering a space needed for installation of the touch screen, a condition for provision of various menus in the products, and increase of production costs due to the usable size of the touch screen. It is because the space needed for the installation of the touch screen should be determined in proportion to the size of the relevant product and the amount of the menus of the product displayed on the touch screen should also be determined according to the size of the touch screen.

As an example, as shown in FIG. 1, the microwave oven is constructed such that the space in which the display device 1, such as the touch screen, for use in the menu display and selection can be installed is restricted to the one side of the cooking chamber 5. Thus, in order to properly display the various menus of the product onto the display device 1 within the restricted space, specific arrangement corresponding thereto is further needed.

It is preferred that the whole display device 1 installed at the possible maximum size be constructed in the form of the touch screen in the conventional manner. However, the costs required for constructing the entire area of the display device in the form of the touch screen cause the increase of the production costs of the product. Accordingly, there is a problem in that it deteriorates merchantability of the product.

SUMMARY OF THE INVENTION

In order to solve the problem, it is necessary to construct only a part of a display device for displaying various kinds of menus of a microwave oven in the form of a touch screen and to effectively control the operation of the display device even in such a partial touch screen construction state.

Accordingly, an object of the present invention is to provide a menu selection device in a microwave oven which is constructed such that the display device of the microwave oven is divided into a menu guide unit and a menu selection unit and only the menu selection unit is constructed and used in the form of a touch screen.

According to an aspect of the present invention for achieving the object, there is provided a display device in a microwave oven, which comprises a menu guide unit on which various kinds of cooking menus are displayed, and a menu selection unit on which symbols corresponding to the various kinds of cooking menus are displayed and which is integrated with the menu guide unit into the single display device and is constructed in the form of a touch screen to allow an arbitrary menu to be selected among the displayed menus.

According to another aspect of the present invention, there is provided a menu selection device in a microwave oven, which comprises a menu guide unit on which various kinds of cooking menus are displayed, a menu selection unit which is integrated with the menu guide unit into a single display device and is constructed in the form of a touch screen to perform input of a signal generated by a touch action thereon, a processor for outputting the cooking menus to be displayed on the menu guide unit, and a signal conversion unit for converting the signal inputted from the menu selection unit into an electrical signal and transmitting the converted electrical signal to the processor.

According to a further aspect of the present invention, there is provided a menu selection device in a microwave oven, which comprises a menu guide unit on which various kinds of cooking menus are displayed, a menu selection unit which is integrated with the menu guide unit into a single display device and is constructed in the form of a touch screen to perform input of a signal generated by a touch action thereon, a processor for outputting the cooking menus to be displayed on the menu guide unit and symbol signals corresponding to the cooking menus displayed on the menu guide unit, an infrared rays generating unit for generating infrared rays in response to the symbol signals outputted from the processor and transmitting the infrared rays across the menu selection unit, and an infrared rays receiving unit for receiving the infrared rays transmitted from the infrared rays generating unit and transmitting a signal indicating the results of reception of the infrared rays to the processor.

BRIEF DESCRIPTION OF THE DRAWINGS

The above and other objects, advantages and features of the present invention will become apparent from the following description of preferred embodiments given in conjunction with the accompanying drawings, in which.

DETAILED DESCRIPTION OF THE INVENTION

Hereinafter, a menu selection device in a microwave oven according to the present invention will be explained in detail with reference to the accompanying drawings.

Figure 1:
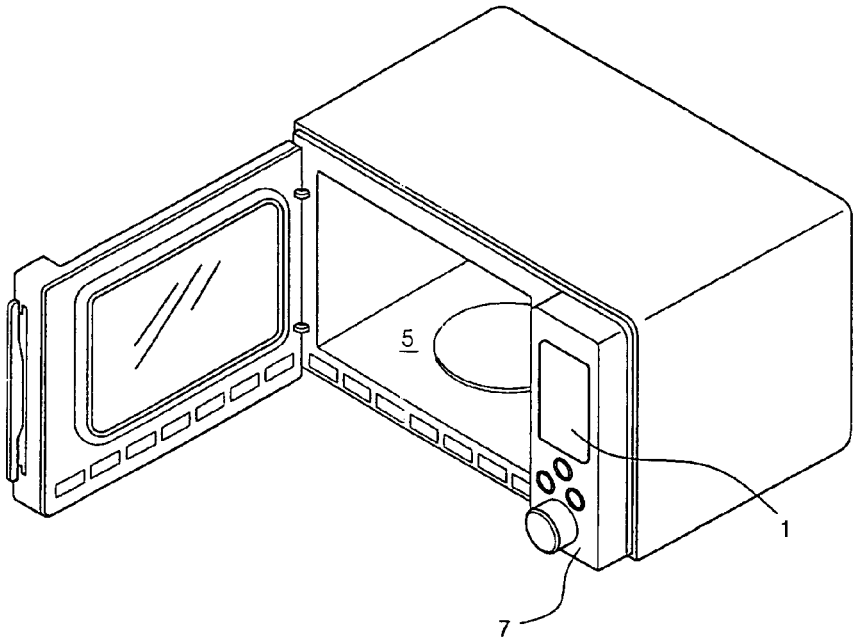
FIG. 1 is a perspective view of a conventional microwave oven.
Figure 2:
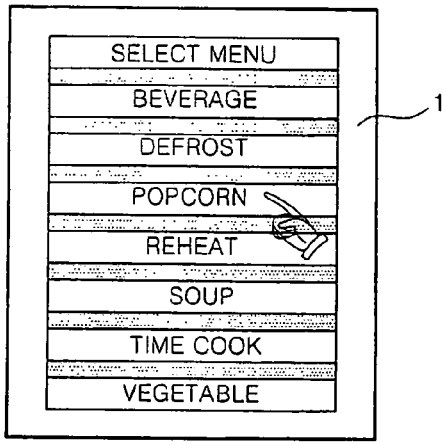
FIG. 2 is a view showing a state where menus of the conventional microwave oven are displayed.
Figure 3:
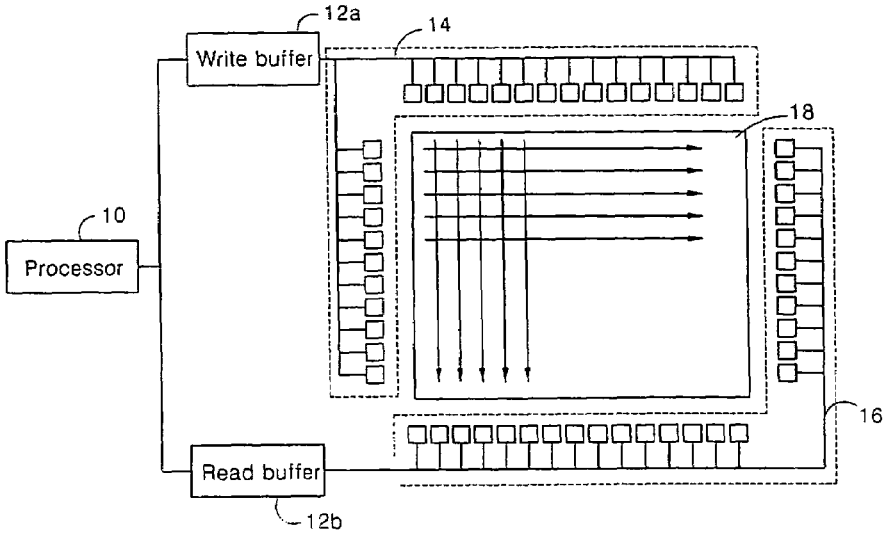
FIG. 3 is a view showing the configuration of controlling a display device of the conventional microwave oven.
Figure 4:
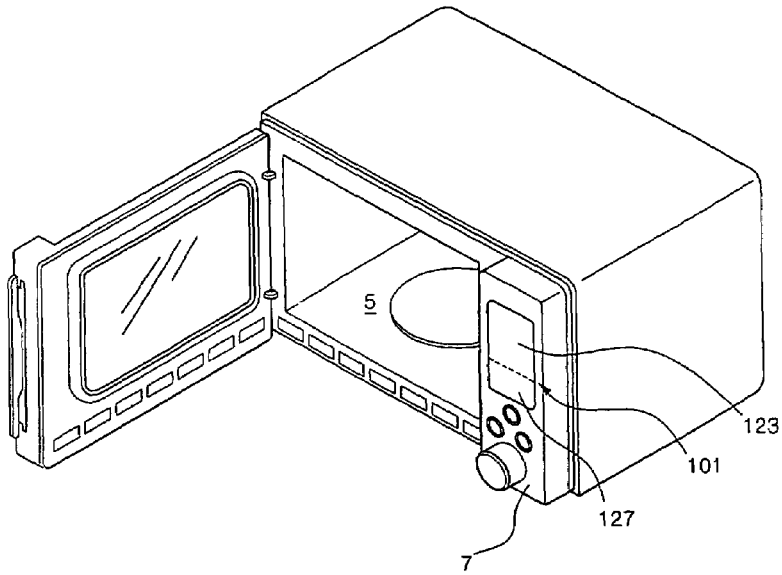
FIG. 4 is a perspective view of a microwave oven according to the present invention.

FIG. 4 is a perspective view of the microwave oven according to the present invention.

The microwave oven of the present invention comprises a display device 101 installed at a control panel of the microwave oven, which is composed of a menu guide unit 123 for displaying menus thereon and a menu selection unit 127 for selecting a desired menu among the various menus displayed on the menu guide unit 123.

The menu guide unit 123 performs only a display function of simply displaying data provided thereto. The menu selection unit 127 is constructed in the form of a touch screen so that any pieces of data can be selected among the data displayed onto the menu guide unit 123. In particular, the menu selection unit 127 is constructed such that predetermined symbols corresponding to various menus displayed on the menu guide unit 123 can be displayed thereon. Further, when any one of the predetermined symbols corresponding to the displayed menus is selected, a specific menu corresponding to the selected symbol can be selected.

Figure 5:
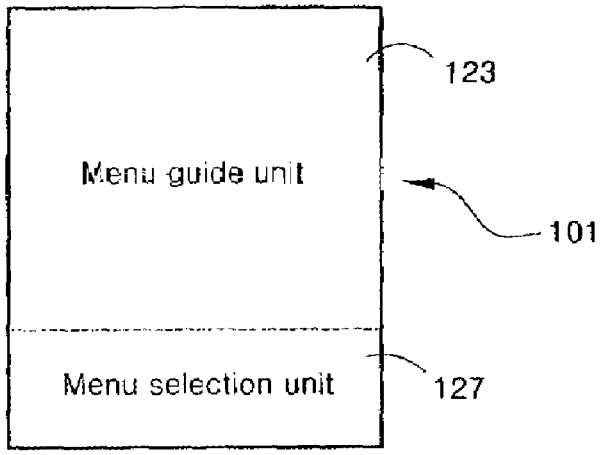
FIGS. 5 and 6 are views showing states where a display device of the microwave oven according to the present invention is used.
Figure 6:
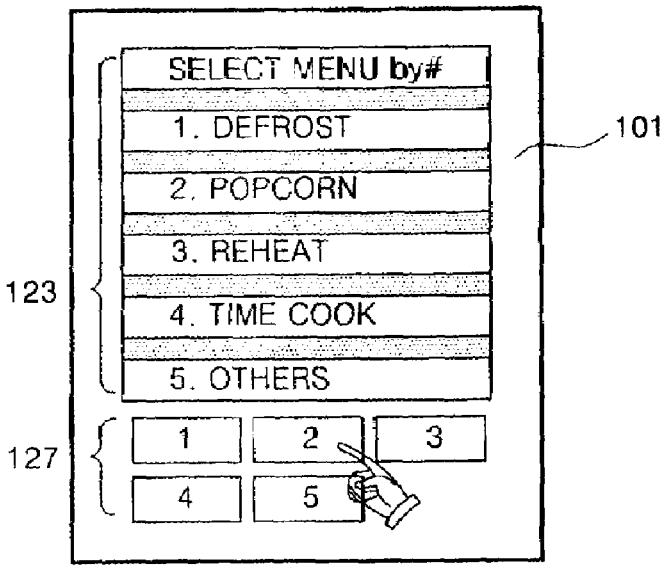

That is, as shown in FIGS. 5 and 6, the display device 101 of the present invention comprises the menu guide unit 123 on which the various menus can be displayed, and the menu selection unit 127 on which the predetermined symbols corresponding to the various menus displayed on the menu guide unit 123 can be displayed and selected. For example, the symbols "1" and "2" are assigned to the menus "DEFROST" and "POPCORN", respectively, in the menu guide unit 123, and the symbols corresponding to all the menus displayed on the menu guide unit 123 are displayed on the menu selection unit 127. Therefore, a user can perform the menu selection by simply selecting the symbol corresponding to a desired menu.

Figure 7:
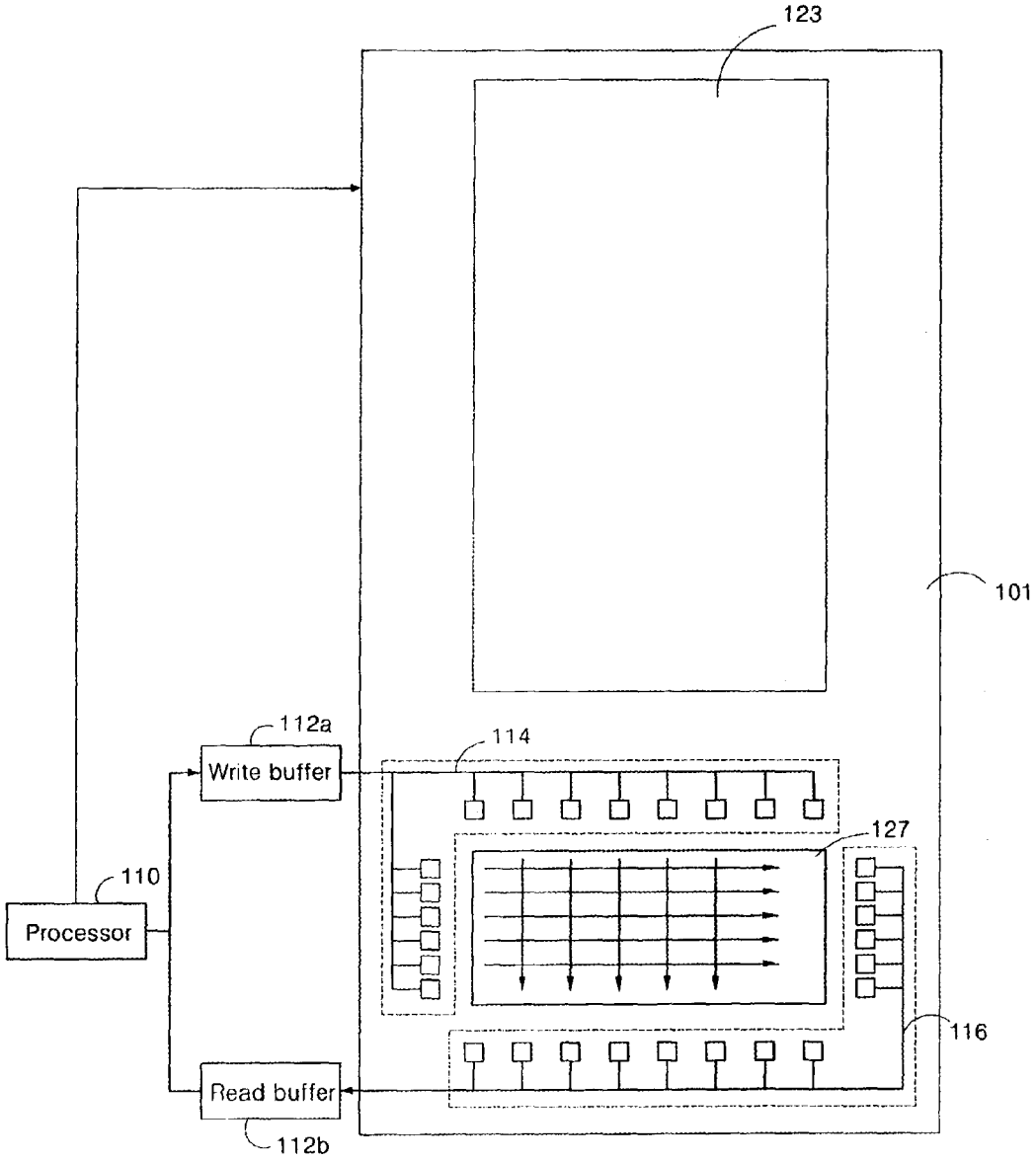
FIG. 7 is a view showing the configuration of controlling the display device of the microwave oven according to the present invention.

Accordingly, if the display device 101 is intended to be used in a state where it is divided into the menu guide unit and the menu selection unit, the display device should be controlled by a control configuration shown in FIG. 7.

The display device 101 includes the menu guide unit 123 and the menu selection unit 127, and the menu guide unit 123 is constructed to allow menu data provided from a processor 110 to be displayed thereon. For example, an LCD device or the like can be utilized in the menu guide unit 123.

Further, the menu selection unit 127 is composed of a CRT display unit, and the constitution for allowing the menu selection unit to function as the touch screen is further provided. That is, the infrared touch screen comprises the processor 110 for generating a relevant control signal by accessing software with an input means such as a finger or a special pen and then processing a coordinate of a position on the CRT display unit 127 touched by the input means, an infrared rays generating unit 114 for generating infrared rays in response to the control signal generated from the processor 110, an infrared rays receiving unit 116 for determining the presence of the infrared rays generated from the infrared rays generating unit 114, and the CRT display unit 127 for displaying the coordinate of the predetermined position touched by the input means on the basis of the presence of the infrared rays. In addition, reference numerals 112*a*, 112*b* designate write and read buffers. The write buffer 112*a* temporarily stores the control signal received from the processor 110 and then transmits the stored signals to the infrared rays generating unit 114, whereas the read buffer 112*b* also temporarily stores data related to the infrared rays from the infrared generating unit 114 and transmits the stored data to the processor 110.

In addition, the infrared rays generating unit 114 is constructed to transmit the infrared rays along an x-axis (abscissa of the figure) and a y-axis (ordinate of the figure) of the CRT display unit 127. Light-emitting devices provided along the x- and y-axes of the infrared rays generating unit 114 are provided to correspond to light-receiving devices of the infrared rays receiving unit 116 to be described later in detail. The infrared rays receiving unit 116 performs a function, of determining the presence of the infrared rays transmitted from the infrared rays generating unit 114 so that the processor 110 can sense a touch action exerted on the CRT display unit 127.

A process of displaying the menus onto the display device 101 and selecting the desired menu among the displayed menus in the microwave oven according the present invention constructed as such will be explained.

Figure 8A:
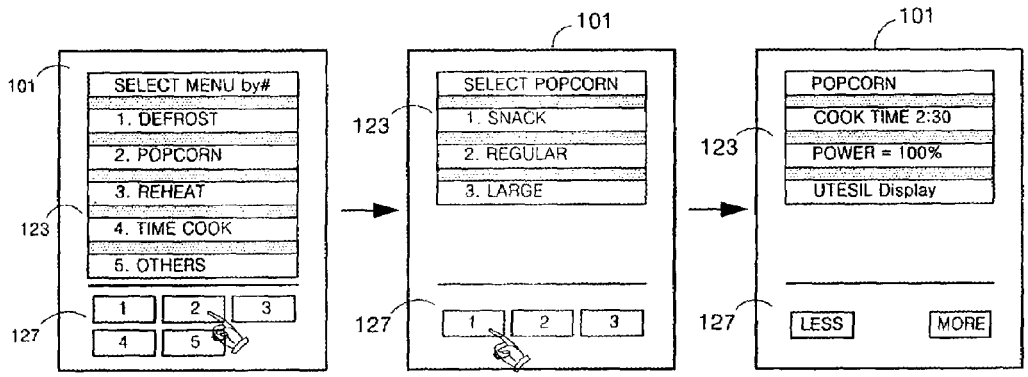
FIGS. 8*a* and 8*b* are views showing states where a display device of the microwave oven according to the present invention is used.

FIG. 8*a* illustrates a case where a snack size of the "POPCORN" menu is selected.

First, the microwave oven of the present invention can be controlled such that the menus such as a first stage of FIG. 8*a* can be displayed when electric power is supplied or the user touches the menu selection unit 127.

At this time, if the operation is performed in accordance with predetermined procedures, the processor 110 causes the menu such as the first stage of FIG. 8*a* to be displayed on the display device 101. That is, the processor 110 causes the various menus and the symbols corresponding to the menus to be displayed on the menu guide unit 123 and the symbols corresponding to the menus displayed on the menu guide unit 123 to be displayed again on the menu selection unit 127.

The symbols are displayed on the menu selection unit 127 by supplying the predetermined control signal outputted from the processor 110 to the infrared rays generating unit 114 through the write buffer 112*a*. The infrared rays generating unit 114 generates the infrared rays in response to the control signal from the processor 110 and transmits the generated infrared rays to the infrared rays receiving unit 116 along the x-and y-axes of the menu selection unit.

If the display onto the display device 101 is made in such a process, the user can determine the desired menu and the symbol corresponding to the menu by referring to menu items displayed on the menu guide unit 123. Then, the user selects the symbol corresponding to the desired menu among the symbols displayed on the menu selection unit 127 and touches the selected symbol with the input means. For example, assume that the user selects and touches the symbol "2" corresponding to the "POPCORN" menu displayed on the menu selection unit 127 in the first stage of FIG. 8*a*.

If the user touches the symbol "2" as such, the infrared rays corresponding to the symbol "2" are not transmitted from the infrared rays generating unit 114 to the infrared rays receiving unit 116. However, the respective infrared rays corresponding to the other symbols are transmitted from the infrared rays generating unit 114 and received by the relevant light-receiving devices of the infrared rays receiving unit 116. Thus, if a state where the infrared rays corresponding to the symbol "2" are not received by the infrared rays receiving unit 116 is recognized by the processor 110 through the read buffer 112*b*, the processor 110 determines that the symbol "2" has been selected.

Then, the processor 110 determines which menu corresponds to the symbol "2" among the menu items displayed on the display device 101 in the first stage of FIG. 8*a* and causes detailed submenus for the menu to be displayed on the display device 101. The current display state is shown in a second stage of FIG. 8*a*.

That is, the processor 110 recognizes that the selected symbol "2" corresponds to the "POPCORN" menu, and causes the detailed submenus for the "POPCORN" menu to be displayed again. At this time, the detailed submenus for the "POPCORN" menu are then displayed on the menu guide unit 123, and the symbols corresponding to the displayed detailed submenus for the "POPCORN" menu are displayed on the menu selection unit 127. Accordingly, as shown in the figure, the three detailed submenus for the "POPCORN" menu are displayed on the menu guide unit 123 and the three symbols corresponding to the submenus are simultaneously displayed on the menu selection unit 127.

Thereafter, the user also determines a desired submenu among the submenus displayed on the menu guide unit 123 of the display device 101 and then selects a predetermined symbol corresponding to the desired submenu on the menu selection unit 127. Lower submenus finally selected in such a manner are shown in a third stage of FIG. 8*a*.

As described above, the display device 101 of the present invention is constructed and controlled such that it is divided into the menu guide unit 123 and the menu selection unit 127, and the menu display can be simply made only on the menu guide unit 123. Further, the menu selection unit 127 is constructed in the form of the touch screen such that any desired menu can be selected among the menus displayed on the menu guide unit 123. At this time, both the menus and the symbols corresponding to the menus are displayed on the menu guide unit 123, whereas only the symbols are displayed on the menu selection unit 127. Therefore, the desired menu can be selected by selecting the symbol corresponding to the relevant menu on the menu selection unit 127.

Accordingly, the processor 110 of the present invention controls the display device 101 in such a manner that the menus and the symbols corresponding thereto are displayed on the menu guide unit 123, and the symbols corresponding to all the menus displayed on the menu guide unit 123 are displayed on the menu selection unit 127 so that the desired menu can be selected by selecting the symbol corresponding to the desired menu among the displayed symbols. Further, the processor 110 can store basic data for the control of the respective menus when performing the display and selection of the menus, and can provide the basic data so that a user condition required for performing the control of the menus can be set.

Figure 8B:
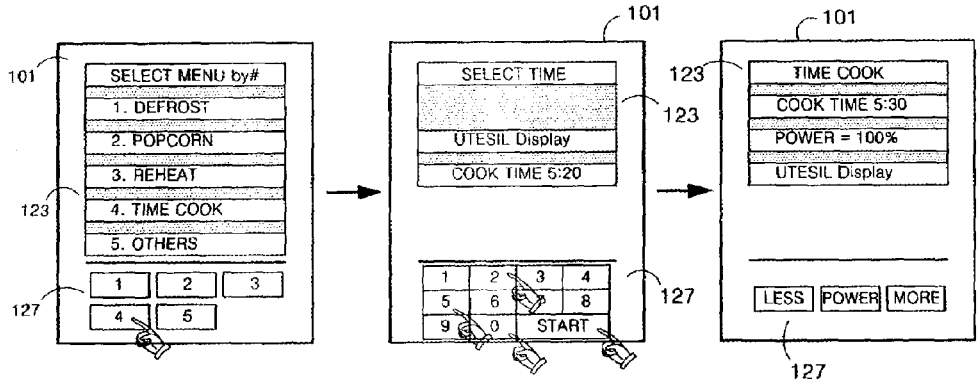

FIG. 8*b* shows a process of setting cooking time.

As shown in a first stage of FIG. 8*b*, various menus and symbols corresponding to the menus are displayed on the menu guide unit 123 of the display device 101 while the various symbols corresponding to the displayed menus are displayed on the menu selection unit 127. At the first stage of FIG. 8*b*, the user may select a symbol "4", corresponding to a "TIME COOK" menu, on the menu selection unit 127.

In the meantime, when the processor 101 causes the menus to be displayed on the menu selection unit 127 of the display device 101 as shown in the first stage of FIG. 8*b*, the processor supplies the control signal to the infrared rays generating unit 114 through the write buffer 112*a* and then causes the infrared rays to be transmitted across the menu selection unit 127. At this time, if the user selects the symbol "4", the infrared rays which will pass through a portion corresponding to the symbol "4" are blocked, whereas the infrared rays which will pass through the other portions except the "4" portion are received by the infrared rays receiving unit 116.

Then, the processor 110 reads, through the read buffer 112*b*, a signal indicating a state where only the infrared rays which will pass across a specific portion on the menu selection unit are blocked, and recognizes that the symbol "4" has been selected. Further, the processor 110 recognizes that the symbol "4" corresponds to the "TIME COOK" menu, and then causes detailed submenus for the selected "TIME COOK" menu (a second stage of FIG. 8*b*) to be displayed on the display device 101.

Thereafter, the user confirms contents displayed on the menu guide unit 123 through the second stage of FIG. 8*b*, and then selects user's setting conditions required for the contents through the menu selection unit 127. Accordingly, the cooking time can be adjusted and set through the above process.

As described above, the present invention has a technical feature in that the display device of the microwave oven is used in a state where it is divided into the menu guide unit and the menu selection unit. The menu guide unit is constructed to perform only the display of the menus thereon, whereas the menu selection unit is constructed in the form of the touch screen so as to perform the display and selection of the symbols corresponding to the menus. Therefore, the present invention has the technical feature in that the user can find out and select the symbol corresponding to the desired menu on the menu selection unit while confirming the contents of the menus displayed on the menu guide unit. To this end, the conditions of the respective cooking menus of the microwave oven can be set, through an input window formed separately from the menu display, by constructing only a part of the display device in the form of the touch screen.

Further, according to the preferred embodiment of the present invention, the desired menus can be selected by causing the symbol corresponding to the menu displayed on the menu guide unit to be selected on the menu selection unit. However, as another preferred embodiment of the present invention, the menu can be recognized by writing down the desired menu directly on the menu selection unit with the input means. In such a case, the various menus are displayed on the menu guide unit, and thus, the user write down the desired menu on the menu selection unit with reference to the menus displayed on the menu guide unit. The menu selection can be made through such a process. That is, the present invention has a technical feature in that the display device is divided into the unit for displaying the stored various menus and the unit for selecting the desired menu among the displayed menus.

According to the present invention described above, the display device of the microwave oven is used in a state where it is divided into the cooking menu guide unit and the menu selection and input unit. Thus, since only the menu selection and input unit is constructed in the form of the touch screen, the whole display device need not be constructed in the form of the touch screen. Accordingly, since a part of the display device is constructed in the form of the touch screen, there are advantages in that the production costs of the products can be reduced and the merchantability of the products can also be enhanced.

Although the present invention has been described in connection with the preferred embodiments with reference to the accompanying drawings, the preferred embodiments are intended not to limit the invention but to exemplify a best mode of the present invention. It will be understood by those skilled in the art that various changes or modifications may be made thereto without departing from the spirit and scope of the invention. Therefore, the present invention is defined only by the appended claims which should be construed as covering such changes or modifications.

What is claimed is:

1. A display device for a microwave oven, comprising:

a first portion configured to display a menu guide screen comprising a plurality of menu selections; and a second portion separate from but in communication with the first portion and configured to display a menu selection screen comprising a plurality of symbols which correspond to the plurality of menu selections displayed on the menu guide screen, wherein the menu guide screen and the menu selection screen are each configured to change each time one of the plurality of symbols displayed on the menu selection screen is used to select a corresponding menu selection of the plurality of menu selections displayed on the menu guide screen.

2. The device of claim 1, wherein the first portion comprises a menu guide unit, and wherein the plurality of menu selections displayed on the first portion comprise a plurality of menu selections which are available in the microwave oven for selection by a user.

3. The device of claim 1 or 2, wherein the second portion comprises a menu selection unit configured to allow a user to select at least one of the plurality of menu selections by selecting a symbol from the plurality of symbols displayed on the second portion which corresponds to the at least one of the plurality of menu selections displayed on the first portion.

4. The device of claim 3, wherein the menu selection unit is further configured to adjust a quantity of the plurality of symbols displayed on the menu selection screen as the plurality of menu selections displayed on the menu guide screen are changed.

5. The device of claim 3, wherein the menu selection unit is further configured to adjust a type of the plurality of symbols displayed on the menu selection screen as the plurality of menu selections displayed on the menu guide screen are changed.

6. The device of claim 5, wherein the menu selection unit is further configured to adjust functional characteristics associated with a menu selection displayed on the menu guide screen.

7. The device of claim 5, wherein the functional characteristics comprise a cooking time and a cooking temperature.

8. The device of claim 2, wherein the menu guide unit comprises a liquid crystal display.

9. The device of claim 3, wherein the menu selection unit comprises a touch screen configured to receive an input from a user, and a signal conversion unit configured to convert the input into a corresponding electrical signal and to transmit the corresponding signal to a controller.

10. The device of claim 9, wherein selections are input to the touch screen through pressure applied to the touch screen by a finger.

11. The device of claim 9, wherein selections are input to the touch screen through the use of a stylus.

12. The device of claim 11, wherein the touch screen is further configured to recognize an image drawn on the touch screen with the stylus.

13. The device of claim 9, wherein the signal conversion unit comprises:

an infrared rays generating unit configured to generate infrared rays in response to a signal from the controller, and to transmit the infrared rays across the menu selection unit; and an infrared rays receiving unit configured to receive the infrared rays transmitted by the infrared ray generating unit, and to transmit a signal to the controller upon reception of the infrared rays.

14. A microwave oven comprising the display device of claim 1.

15. A display device for a microwave oven, comprising:

a menu guide unit configured to display a plurality of menu guide screens comprising a plurality of menu selection options available; and a menu selection unit separate from but in communication with the menu guide unit and configured to display a plurality of menu selection screens corresponding to the plurality of menu guide screens displayed by the menu guide unit, each menu selection screen including a plurality of symbols which correspond to the plurality of menu selection options, wherein the menu guide unit and the menu selection unit are configured to display a new menu guide screen and a new menu selection screen, respectively, corresponding to a menu selection option selected by selecting its corresponding symbol displayed on the menu selection screen.

16. The device of claim 15, wherein the plurality of menu guide screens comprises a successive plurality of menu guide screens and the plurality of menu selection screens comprises a successive plurality of menu selection screens each corresponding to a respective menu guide screen of the successive plurality of menu guide screens.

17. The device of claim 16, wherein each of the successive plurality of menu guide screens comprises a different combination of menu selection options, and each of the successive plurality of menu selection screens comprises a different combination of symbols.

18. The device of claim 15, wherein the menu selection unit is further configured to adjust at least one of a quantity and a type of symbol displayed in the plurality of menu selection screens based on a menu guide screen displayed by the menu guide unit.

19. The device of claim 15, wherein the menu selection unit is further configured to adjust functional characteristics associated with a menu selection screen displayed on the menu guide unit.

20. The device of claim 19, wherein the functional characteristics comprise a cooking time and a cooking temperature.

21. The device of claim 15, wherein the menu guide unit comprises a liquid crystal display, and the menu selection unit comprises a touch screen.

22. The device of claim 15, wherein the plurality of menu selection options comprise a plurality of cooking options available.

23. A display device for a microwave oven, comprising:

a menu guide unit configured to display a first menu guide screen comprising a first plurality of menu selection options; and a menu selection unit separate from but in communication with the menu guide unit and configured to display a first menu selection screen comprising a first plurality of symbols corresponding to the first plurality of menu selection options displayed on the first menu guide screen, wherein the menu guide unit and the menu selection unit are configured to display a second menu guide screen comprising a second plurality of menu selection options and a second menu selection screen comprising a second plurality of symbols corresponding to the second plurality of menu selection options, respectively, when one of the first plurality of symbols is activated to select its corresponding menu selection option of the first plurality of menu selection options.

24. The device of claim 23, wherein the menu guide unit and the menu selection unit are further configured to display a third menu guide screen comprising a third plurality of menu selection options and a third menu selection screen comprising a third plurality of symbols corresponding to the third plurality of menu selection options, respectively, when one of the second plurality of symbols is activated to select its corresponding menu selection option of the second plurality of menu selection options.

* * * * *